US012390027B2

(12) United States Patent
Roberson

(10) Patent No.: US 12,390,027 B2
(45) Date of Patent: Aug. 19, 2025

(54) WALL MOUNTING DEVICE AND METHODS OF MAKING AND USING THE SAME

(71) Applicant: Andrew J. Roberson, Durham, NC (US)

(72) Inventor: Andrew J. Roberson, Durham, NC (US)

( * ) Notice: Subject to any disclaimer, the term of this patent is extended or adjusted under 35 U.S.C. 154(b) by 103 days.

(21) Appl. No.: 18/098,238

(22) Filed: Jan. 18, 2023

(65) Prior Publication Data

US 2024/0237838 A1 Jul. 18, 2024

(51) Int. Cl.
*A47G 1/16* (2006.01)

(52) U.S. Cl.
CPC ..... *A47G 1/16* (2013.01)

(58) Field of Classification Search
CPC ..... A47G 1/16; A47G 1/22
USPC ..... 248/466, 544, 547
See application file for complete search history.

(56) References Cited

U.S. PATENT DOCUMENTS 3,091,423 A 5/1963 Butterworth
5,199,200 A * 4/1993 Howell ..... A47G 1/0616 40/799
5,441,777 A * 8/1995 Howell ..... B44F 1/00 428/117
5,444,929 A * 8/1995 Joseloff ..... G09F 1/10 40/657
6,345,822 B1 * 2/2002 Reynolds ..... A63F 3/00261 273/287
6,684,518 B2 * 2/2004 Voorhees ..... A47G 1/205 248/495
7,421,796 B1 * 9/2008 DeAngelis-Morris ..... A47G 1/205 33/1 G
7,856,732 B2 * 12/2010 Townsend ..... F16M 13/02 33/613
8,333,026 B2 * 12/2012 Southard ..... A47G 1/16 40/745
11,011,148 B1 * 5/2021 Johnson ..... E04H 17/16
11,096,508 B1 * 8/2021 Lawton ..... A47G 1/06
11,330,918 B2 5/2022 Ward et al.
2005/0173059 A1 * 8/2005 Ringleben ..... B29C 65/524 156/291
2007/0095997 A1 * 5/2007 Case ..... A47G 1/164 248/309.1
2013/0247401 A1 * 9/2013 Miller ..... G01C 9/12 33/379
2015/0342373 A1 * 12/2015 Toth ..... E04F 13/0851 428/58

(Continued)

*Primary Examiner* — Muhammad Ijaz
(74) *Attorney, Agent, or Firm* — Ashley D. Johnson; Dogwood Patent and Trademark Law

(57) ABSTRACT

The invention is a device (e.g., frame, mirror, picture) that can be easily and efficiently hung on a wall or other support surface. Specifically, the device includes a grid positioned on a rear face of the device, closest to the support surface. The device includes a front face that can include a visual element (e.g., a reflective surface, a painting, a poster, display of many types of images, such as artwork, photo prints, posters, etc.) surrounded by a frame that extends about the circumference of the device. A rear face of the device includes the grid that enables the device to be quickly and easily positioned at a desired location on the support surface. Advantageously, the grid enables a user to position and hang the device from a single point on the support surface if desired.

20 Claims, 11 Drawing Sheets

(56) References Cited

U.S. PATENT DOCUMENTS

| | | | | |
|---|---|---|---|---|
| 2016/0123524 | A1* | 5/2016 | Burkhard | F16M 13/00 29/446 |
| 2017/0059084 | A1* | 3/2017 | Krake | A47G 1/162 |
| 2021/0137289 | A1* | 5/2021 | Ward | A47G 1/06 |
| 2022/0240695 | A1* | 8/2022 | Schabel, Jr. | A47G 1/1613 |
| 2022/0338910 | A1* | 10/2022 | Kucklick | A61F 2/30756 |
| 2024/0188733 | A1* | 6/2024 | Kish | A47F 7/0042 |
| 2024/0237838 | A1* | 7/2024 | Roberson | A47G 1/22 |

* cited by examiner

WALL MOUNTING DEVICE AND METHODS OF MAKING AND USING THE SAME

TECHNICAL FIELD

The presently disclosed subject matter is generally directed to a wall mounting device comprising a rear-facing grid configured to cooperate with an anchoring member positioned on a support wall. The presently disclosed subject matter further includes methods of making and using the disclosed device.

BACKGROUND

Conventional pictures, mirrors, and other wall hangings are typically secured using one or more wall anchors (such as nails, screws, or special purpose hanging brackets) that catch or otherwise mechanically communicate with a wire horizontally attached to the rear or "wall side" of the object to be hung. In the case of mirrors, mounting is provided by fixed hardware on the back of the mirror that may or may not be properly aligned, thereby leading to poor hanging alignment. The first step in hanging a device on a wall is to determine the desired height and position of the device. For most people, this is a difficult task. Typically, a first person must hold the device against a wall while a second person determines the desired height and position from across the room. For the first person to be able to view the device against the wall, the second person must take the first person's place as picture holder. Once the proper height and position are determined, the user must determine the proper location to insert an anchor to hang the device, which presents a challenge. For example, it may be difficult to properly position a hook in a wall to catch a wire that is horizontally strung against a picture. It can further be challenging to properly align the hanging implement to ensure that the device is at the desired location and height, which can take multiple insertion and removals of the hanging implement. The trial and error results in damage to walls and the device itself can be damaged in the process. It would therefore be beneficial to provide a hanging device that overcomes the shortcomings of the prior art.

SUMMARY

In some embodiments, the presently disclosed subject matter is directed to a hanging device comprising a front face and an opposed rear face. The device further includes a frame at least partially surrounding the front and rear faces. The rear face comprises a grid defined by a plurality of apertures that extend towards the front face. The plurality of apertures do not extend to the front face.

In some embodiments, the apertures are formed from a plurality of intersecting wires that are attached or connected to the rear face.

In some embodiments, the apertures are configured as individual openings on the rear face.

In some embodiments, at least one aperture differs from at least one other aperture with respect to size, shape, or depth.

In some embodiments, each aperture has a depth of about 0.01-1 inches.

In some embodiments, the depth of each aperture is about 1-20 percent of a thickness of the hanging device.

In some embodiments, the depth of each aperture is about 20-50 percent of a thickness of the hanging device.

In some embodiments, the hanging device comprises about 100-1000 apertures. In some embodiments, the apertures are positioned on about 100 percent of the rear face of the device.

In some embodiments, the apertures are positioned on about 20-50 percent of the rear face of the device.

In some embodiments, the presently disclosed subject matter is directed to a method of retaining a hanging device on a support surface. Particularly, the method comprises determining a proper position for retaining the hanging device on the support surface. The hanging device is defined by a front face and an opposed rear face and a frame at least partially surrounding the front and rear faces. The rear face comprises a grid defined by a plurality of apertures that extend towards the front face, and the plurality of apertures do not extend to the front face. The method includes positioning a first end of a hanging implement in the support surface at the proper position for retaining the hanging device. The method further includes inserting a second end of the hanging implement into an aperture of the hanging device, where the aperture is adjacent to the second end of the hanging device, whereby the hanging device is retained on the support surface.

In some embodiments, the hanging implement is a nail, hook, or bracket.

In some embodiments, the proper position for retaining the hanging device is adjustable without moving the location of the hanging implement in the support surface.

DETAILED DESCRIPTION

Figure 1A:
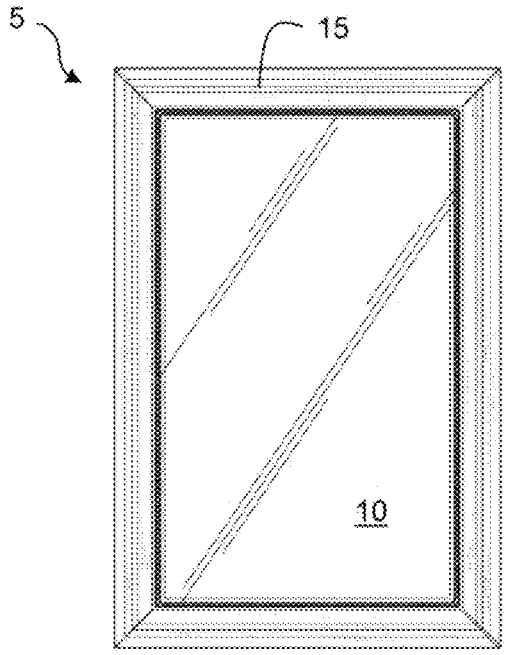
FIG. 1*a* is a front plan view of a hanging device in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
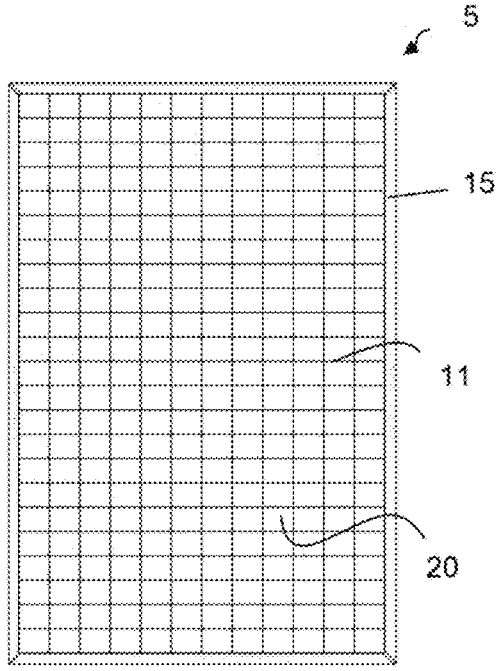
FIG. 1*b* is a rear plan view of a hanging device in accordance with some embodiments of the presently disclosed subject matter.
Figure 2A:
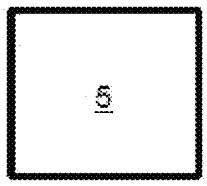
FIGS. 2*a*-2*l* are front plan views of hanging devices in a plurality of different shapes in accordance with some embodiments of the presently disclosed subject matter.
Figure 2B:
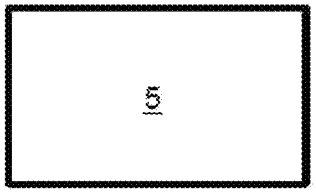
Figure 2C:
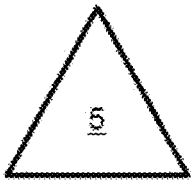
Figure 2D:
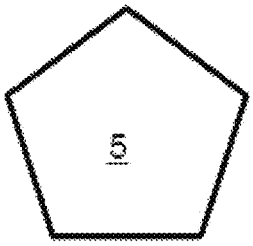
Figure 2E:
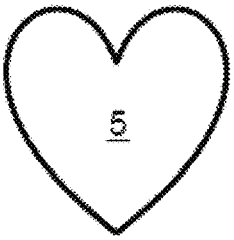
Figure 2F:
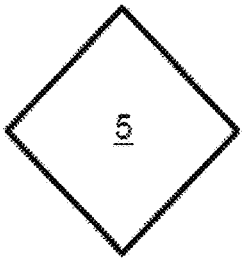
Figure 2G:
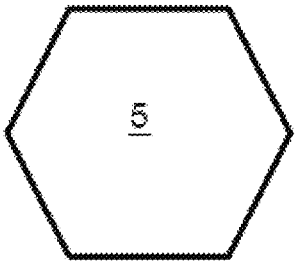
Figure 2H:
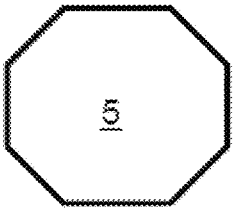
Figure 2I:
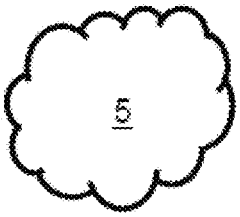
Figure 2J:
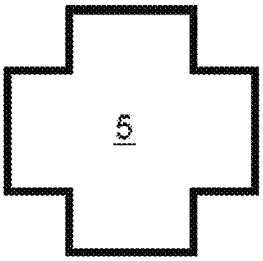
Figure 2K:
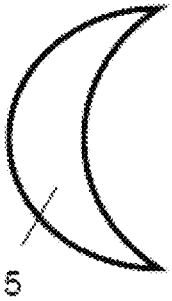
Figure 2L:
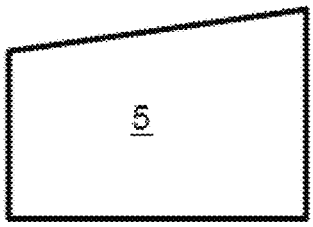

The presently disclosed subject matter is directed to a device (e.g., mirror, picture, artwork) that can be easily and efficiently hung on a wall or other support surface. Specifically, the device includes a grid positioned on a rear face of the device, closest to the support surface. The term "grid" refers to a pattern or series of apertures. FIGS. 1*a* and 1*b* illustrate one embodiment of device 5 that can be removably hung on a support surface. As shown, the device includes front face 10 that can include a visual element (e.g., a reflective surface, a diploma, a painting, a poster, etc.) surrounded by frame 15 that extends about the circumference of the device. Rear face 11 includes grid 20 surrounded by the frame. The grid enables device 5 to be quickly and easily positioned at a desired location on the support surface, as set forth in more detail herein below. Advantageously, the grid enables a user to position and hang the device from a single point on the support surface if desired.

As set forth above, device 5 can be configured as any element that a user wishes to hang on a support surface. Thus, the device can include (but is not limited to) a mirror, painting, drawing, display board, poster, artwork, shadowbox, document, diploma, clock, light, cabinet, shelf, and the like. In some embodiments, the device can include any element comprising a frame. In other embodiments, the frame is optional.

Device 5 can be configured in any desired shape, such as (but not limited to) square, rectangular, triangular, pentagonal, heart-shaped, diamond-shaped, hexagonal, octagonal, cloud-shaped, cross-shaped, crescent shaped, and abstract, as shown in FIGS. 2*a*-2*k*. It should be appreciated that the device shape is not limited and can assume any shape.

Figure 3:
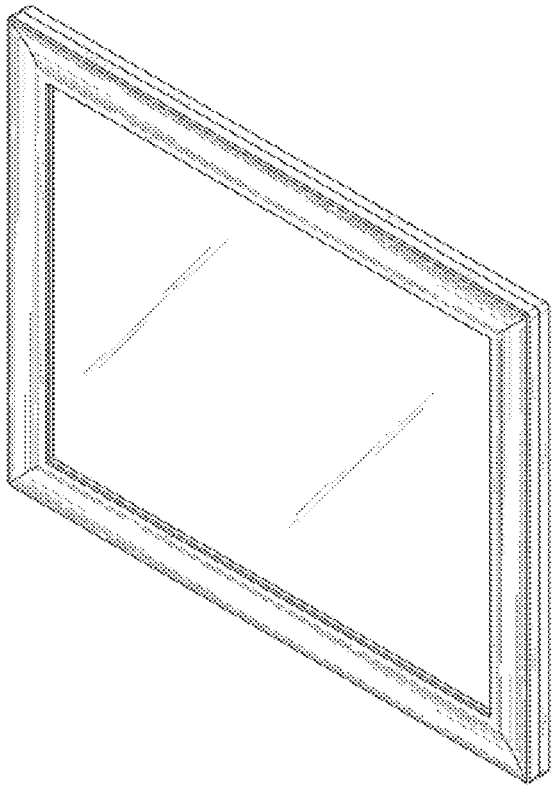
FIG. 3 is a perspective view of the front face of a hanging device in accordance with some embodiments of the presently disclosed subject matter.

Device 5 includes frame 15 that extends about the circumference of device 5, as shown in FIG. 3. The term "frame" broadly refers to any protective and/or decorative edging that at least partially surrounds the disclosed device.

Frame 15 can be constructed from any suitable material and is not limiting. For example, the frame can be constructed from metal, plastic, carbon fiber, ceramic, wood, glass, leather, fabric, composite board, stone, cement, or combinations thereof.

Figure 4A:
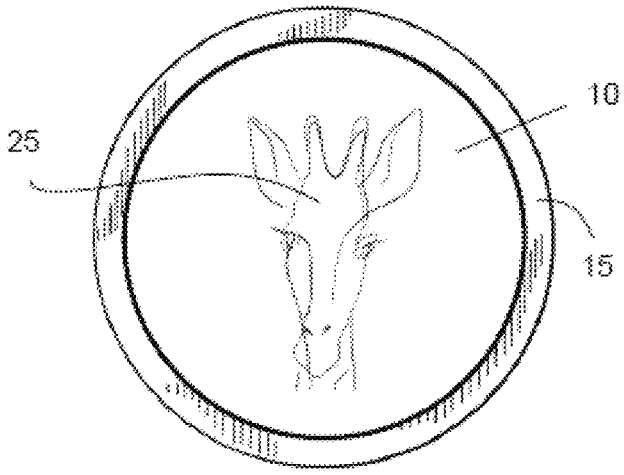
FIG. 4*a* is a front plan view of a hanging device front face in accordance with some embodiments of the presently disclosed subject matter.
Figure 4B:
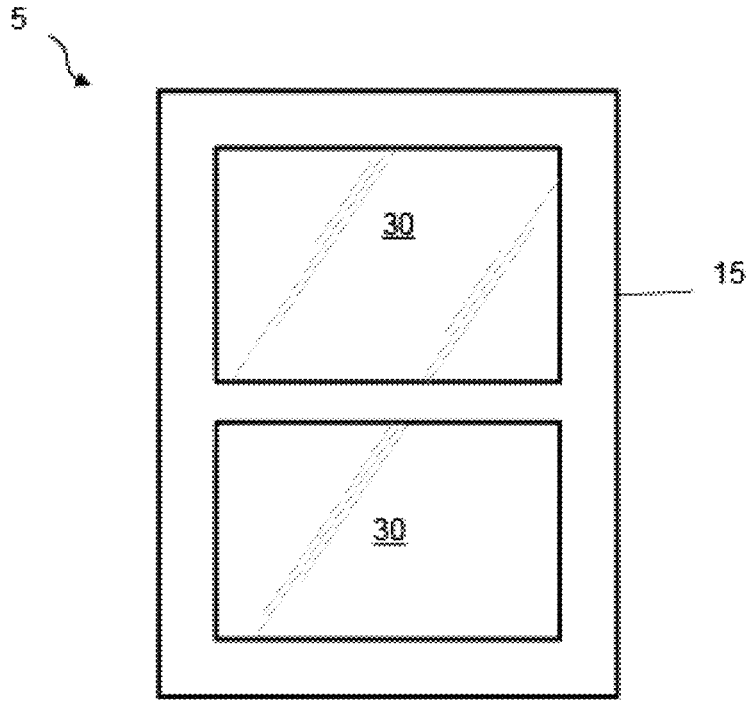
FIG. 4*b* is a front plan view of a hanging device comprising multiple sections in accordance with some embodiments of the presently disclosed subject matter.
Figure 4C:
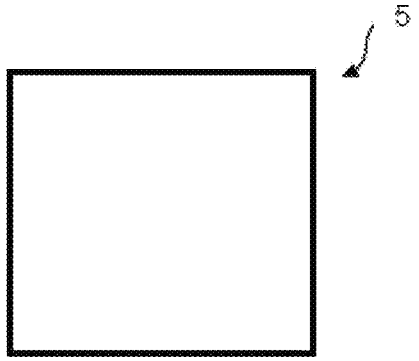
FIG. 4*c* is a front plan view of a hanging device configured without a frame in accordance with some embodiments of the presently disclosed subject matter.
Figure 4D:
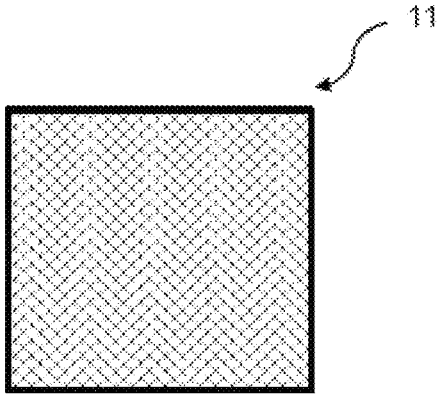
FIG. 4*d* is a rear plan view of a hanging device configured without a frame in accordance with some embodiments of the presently disclosed subject matter.

As set forth above, device 5 includes front face 10 and opposed rear face 11. The term "front face" refers to the face positioned outwardly facing a room when the device is in use. The front face includes visual element 25 that is displayed for users to see and/or interact with. As noted above, the visual element can include a reflective surface, a picture, artwork, photo, print, poster, document, or similar display object of varying thickness or rigidity. Accordingly, the visual element includes any object having dimensions (i.e., length, width, and thickness) to be displayed, as shown in FIG. 4*a*. In some embodiments, front face 10 can include a plurality of compartments 30 to allow for the display of multiple visual elements, as shown in FIG. 4*b*. In these embodiments, frame 15 can extend about the circumference of the device and also at least partially across a portion of front face 10. To this end, the disclosed grid system does not have to be surrounded by frame 15 for the device to work. For example, the grid can be mounted to the front and/or back surface of the device and make a "frameless" appearance, as shown in FIGS. 4*c* and 4*d*. Thus, frame 15 can be optional and/or only configured adjacent to the front face of device 5 in some embodiments.

Figure 5:
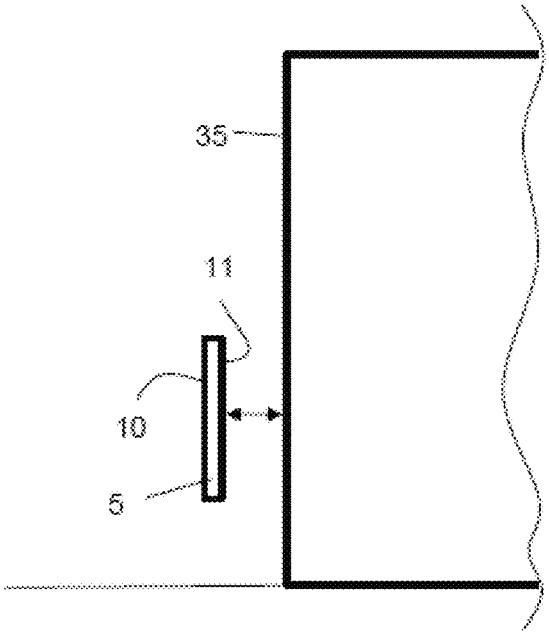
FIG. 5 is a side plan view of a device being positioned on a support surface in accordance with some embodiments of the presently disclosed subject matter.
Figure 6A:
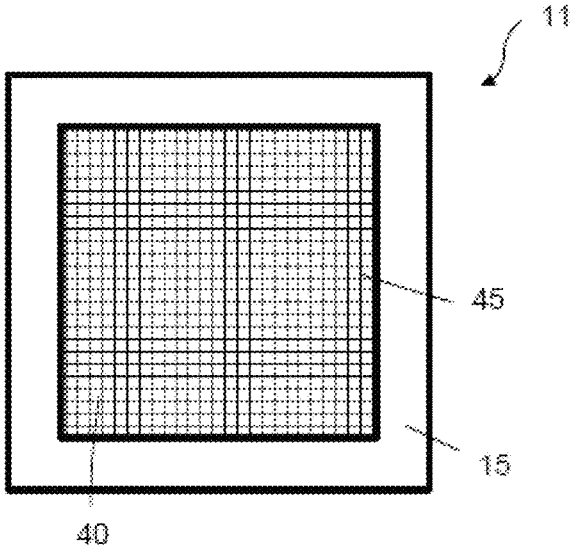
FIGS. 6*a*-6*d* are front plan views of device rear faces comprising grids in accordance with some embodiments of the presently disclosed subject matter.
Figure 6B:
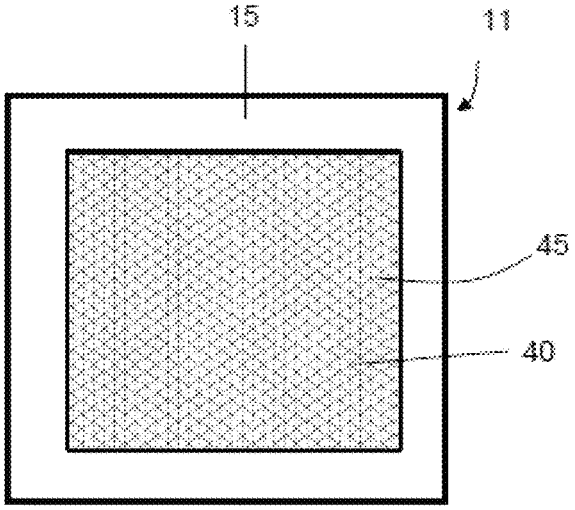
Figure 6C:
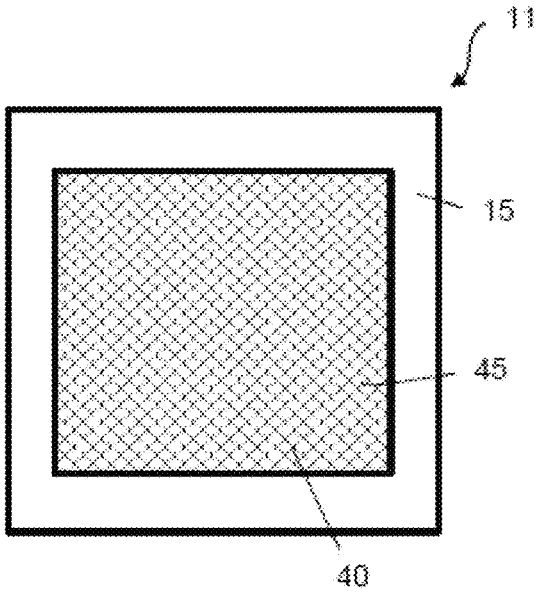
Figure 6D:
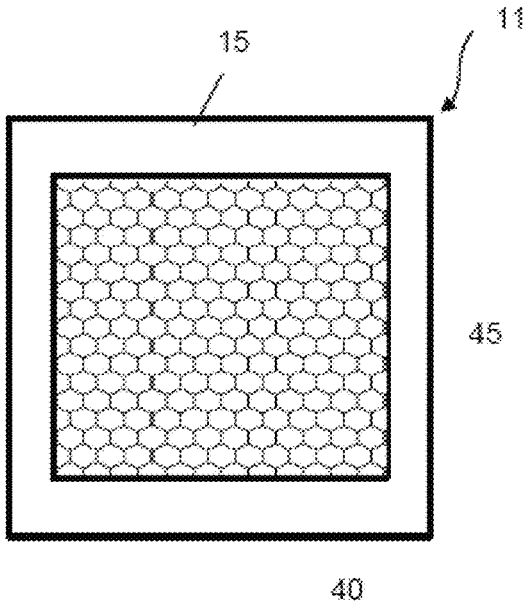

Device rear face 11 is positioned to oppose the front face. The term "rear face" is the device face that is positioned adjacent to (and facing) a support surface when the device is hung (e.g., wall 35), as shown in FIG. 5. As noted above, rear face 11 of the device includes grid 20 comprising a plurality of grid apertures. It should be appreciated that the grid does not extend to front face 10 and is limited to the rear face of the device. The grid can have any desired configuration so long as it includes a plurality of apertures 40. The term "aperture" refers to any type of opening, such as a hole, gap, slit, cleft, and the like. The apertures can take any desired shape (e.g., circular, oval, square) and size. In some embodiments, apertures 40 can have about the same size and/or shape. In other embodiments, the size and/or shape of at least one aperture can differ from at least one other aperture, such as to accommodate a variety of hanging implements.

In some embodiments, grid 20 can be formed by a series of intercrossing wires, as shown in FIGS. 6*a*-6*d*. Specifically, wires 45 can be oriented relative to each other to create apertures 40. For example, the wires can include a plurality of first wires oriented parallel to each other, and a plurality of second wires oriented parallel to each other and perpendicular to the plurality of first wires. However, any desired arrangement of wires can be used to create the apertures. The wires can be constructed from any suitable material, such as metal (e.g., aluminum, copper, stainless steel), plastic, and the like.

The grid can be secured on rear face 11 using any suitable method, such as the use of adhesives, mechanical elements (staples, nails, fasteners), welding, or combinations thereof that interact with the frame.

Figure 7:
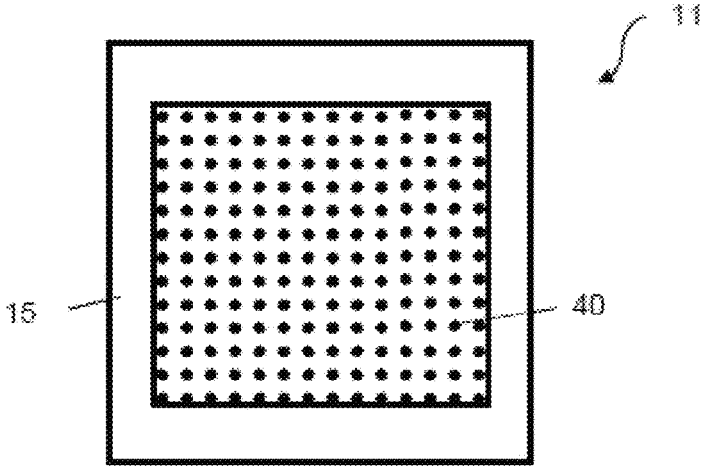
FIG. 7 is a front plan view of a device rear face in accordance with some embodiments of the presently disclosed subject matter.

In other embodiments, the grid can be formed by providing multiple apertures in rear face 11 as shown in FIG. 7. The apertures can be configured as openings formed using any suitable method, such as (but not limited to) laser cutting, die cutting, drilling, the use of a sharp item (e.g., blade), and the like.

Figure 8A:
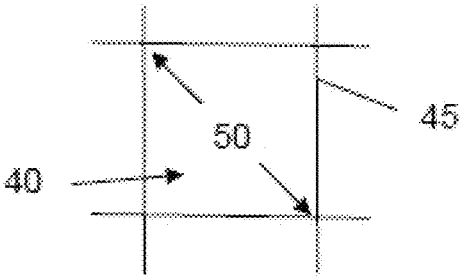
FIGS. 8*a* and 8*b* are top plan views of grid apertures in accordance with some embodiments of the presently disclosed subject matter.
Figure 8B:
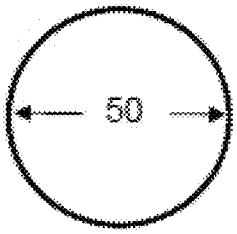

Apertures 40 can be configured in any desired size or combination of sizes. For example, each aperture can include diameter 50 of about 0.01-1 inch in some embodiments (e.g., at least/no more than about 0.01, 0.05, 0.1, 0.2, 0.3, 0.4, 0.5, 0.6, 0.7, 0.8, 0.9, or 1 inch). The term "diameter" refers to the longest straight line distance passing through the center of a cross-section of the aperture, as illustrated in FIGS. 8*a* and 8*b*. It should be appreciated that apertures 40 are not limited and can be configured with a diameter outside the range above.

Apertures 40 can further be configured in any desired shape, such as (but not limited to) square, rectangular, circular, oval, triangular, and the like.

Figure 8C:
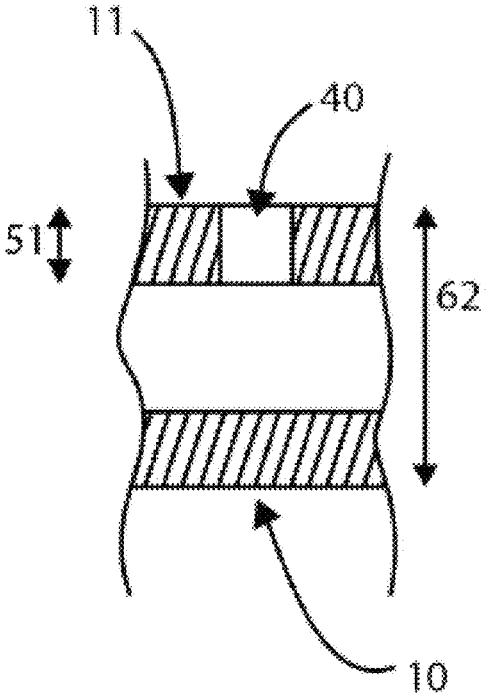
FIG. 8*c* is a fragmentary side cross-sectional view of a device aperture in accordance with some embodiments of the presently disclosed subject matter.

Each aperture can further include depth 51 of about 0.01-1 inches (e.g., at least/no more than about 0.01, 0.05, 0.1, 0.2, 0.3, 0.4, 0.5, 0.6, 0.7, 0.8, 0.9, or 1 inch). The term "depth" refers to the distance of each aperture measured inward from the rear face, as shown in FIG. 8*c*. In some embodiments, the depth of the apertures can be about 1-80% of the device thickness 62 (e.g., at least/no more than about 1, 5, 10, 15, 20, 25, 30, 35, 40, 45, 50, 55, 60, 65, 70, 75, or 80 percent). Depth 51 of the apertures should be sufficient to accommodate a hanging implement (e.g., hook, nail, etc.).

In some embodiments, each aperture 40 on rear face 11 is configured in about the same size, depth, and shape. However, the presently disclosed subject matter is not limited and at least one aperture can differ from at least one other aperture with respect to shape, size, and/or depth (e.g., to accommodate a variety of different wall hanging implements).

Rear face 11 can include any number of apertures, such as about 10-1000 or more (e.g., at least/no more than about 10, 50, 100, 150, 200, 250, 300, 350, 400, 450, 500, 550, 600, 650, 700, 750, 800, 850, 900, 950, or 1000). It should be appreciated that the number of apertures 40 depends on the size of a particular device. For example, a large mirror measuring 5 feet×7 feet will inherently include more apertures compared to a small 8 inch×11 inch painting.

Figure 9:
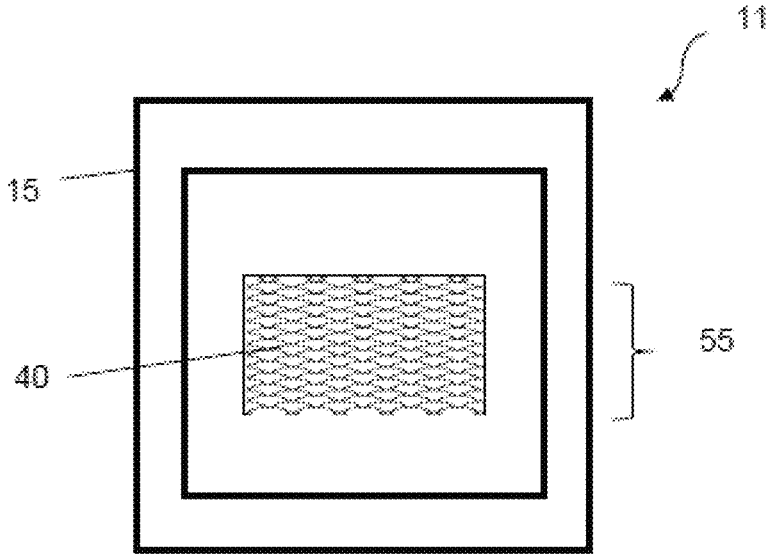
FIG. 9 is a rear plan view of a hanging device in accordance with some embodiments of the presently disclosed subject matter.

In some embodiments, apertures 40 span the full rear face, as shown in the embodiments of FIGS. 6*a*-6*d*. However, the rear face can be configured to include hanging area 55 that includes the apertures, where the hanging area makes up less than the entire rear face of device 5, as shown in FIG. 9. Thus, apertures can be positioned in a hanging area that makes up about 20-100% of the rear face of the device (e.g., at least/no more than about 20, 25, 30, 35, 40, 45, 50, 55, 60, 65, 70, 75, 80, 85, 90, 95, 99, or 100 weight percent. The hanging area can be located anywhere on rear surface 11, such as in the center, at/near a top edge, at/near a bottom edge, at/near a right edge, at/near a left edge, offset from the center, or combinations thereof.

Figure 10A:
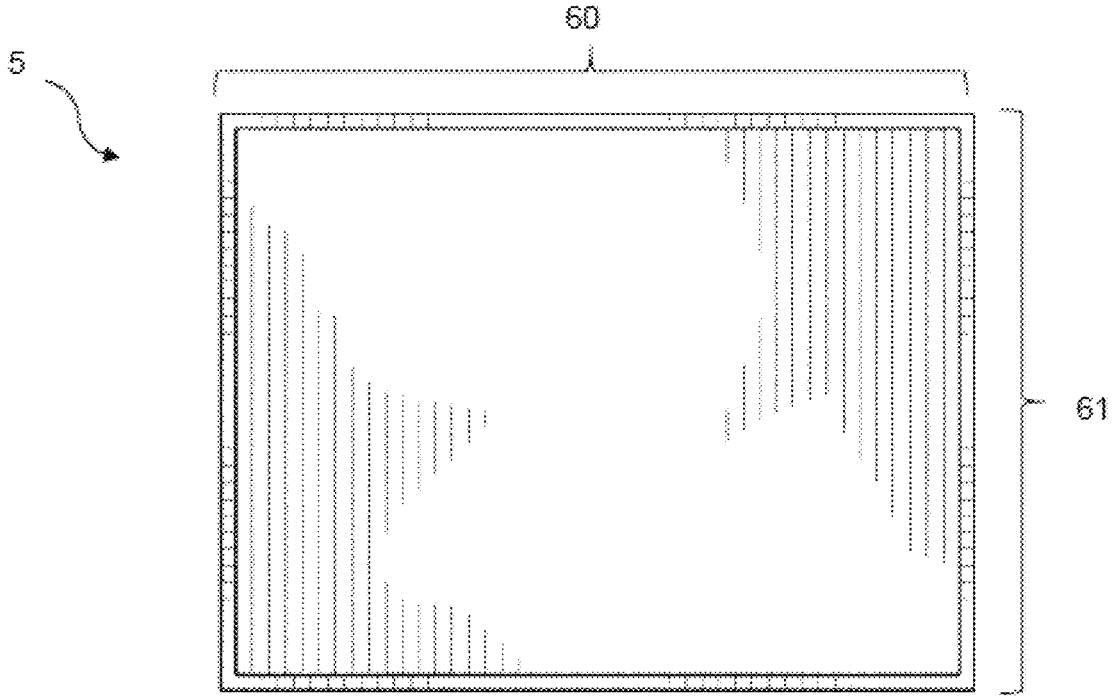
FIG. 10*a* is a front plan view of a hanging device in accordance with some embodiments of the presently disclosed subject matter.
Figure 10B:
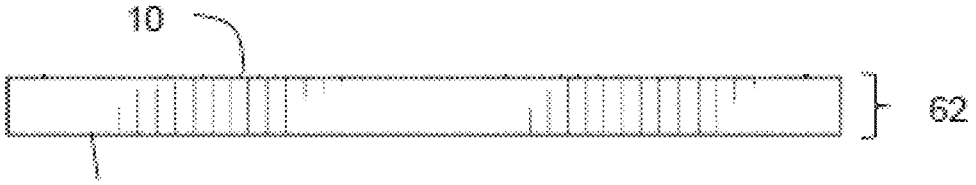
FIG. 10*b* is a side plan view of a hanging device in accordance with some embodiments of the presently disclosed subject matter.

Device 5 can be configured in any suitable size for any suitable application. Thus, the device can include length 60 and/or width 61 of about 6 inches to about 10 feet or more (e.g., at least/no more than about 0.5, 1, 1.5, 2, 2.5, 3, 3.5, 4, 4.5, 5, 5.5, 6, 6.5, 7, 7.5, 8, 8.5, 9, 9.5, or 10 feet). The term "length" refers to the longest horizontal distance of the device, as shown in FIG. 10*a*. The term "width" refers to the longest vertical distance of the device. The device can further include any suitable thickness 62, such as about 0.5-10 inches or more (e.g., at least/no more than about 0.5, 1, 1.5, 2, 2.5, 3., 3.5, 4, 4.5, 5, 5.5, 6, 6.5, 7, 7.5, 8, 8.5, 9, 9.5, or 10 inches). The term "thickness" refers to the distance between front and rear faces 10, 11, as shown in FIG. 10*b*. It should be noted that the presently disclosed subject matter is not limited and the length, width, and thickness of device 5 can be configured outside the ranges given above.

Figure 11:
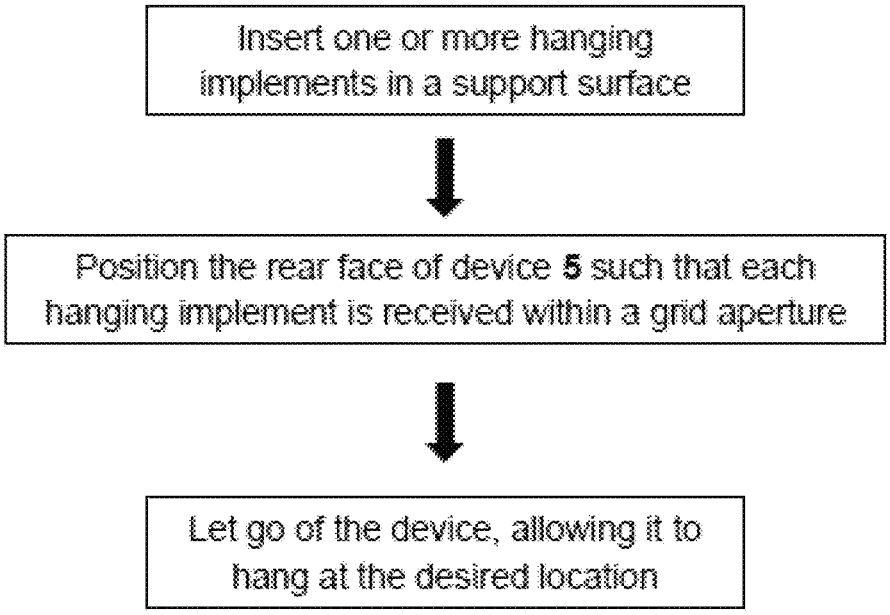
FIG. 11 is a schematic illustrating one method of using a hanging device in accordance with some embodiments of the presently disclosed subject matter.
Figure 12A:
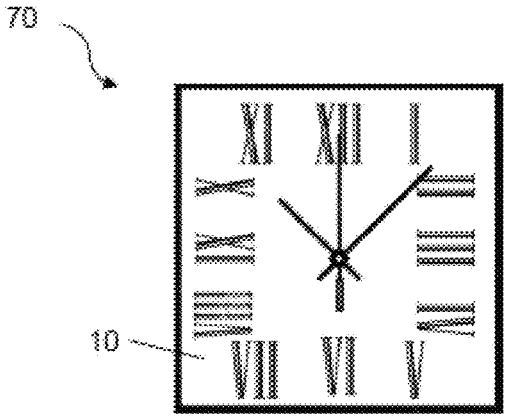
FIG. 12*a* is a front plan view of a clock in accordance with some embodiments of the presently disclosed subject matter.
Figure 12B:
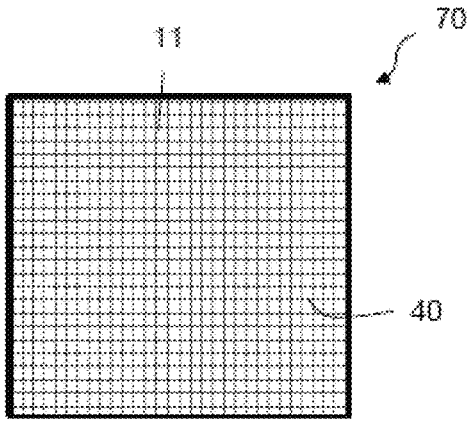
FIG. 12*b* is a rear plan view of the clock of FIG. 12*a* in accordance with some embodiments of the presently disclosed subject matter.
Figure 12C:
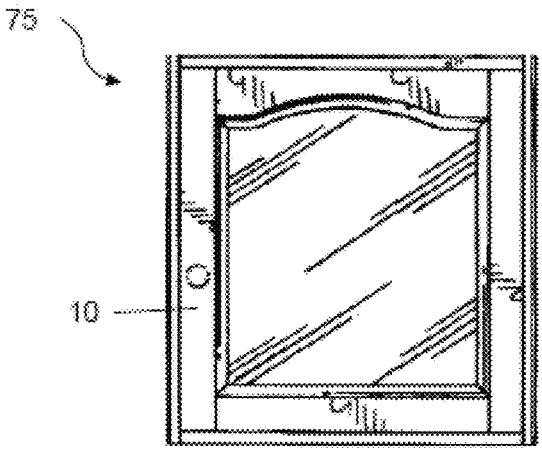
FIG. 12*c* is a front plan view of a cabinet in accordance with some embodiments of the presently disclosed subject matter.
Figure 12D:
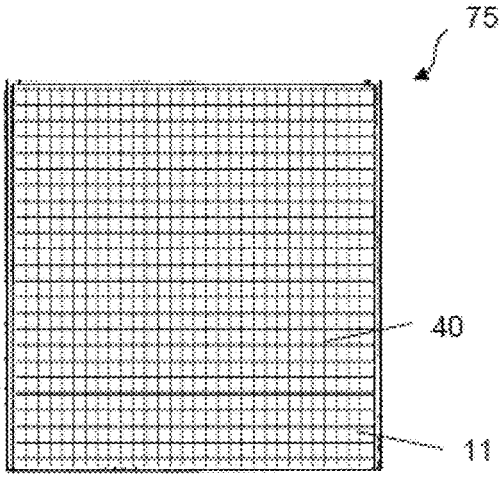
FIG. 12*d* is a rear plan view of the cabinet of FIG. 12*c* in accordance with some embodiments of the presently disclosed subject matter.
Figure 13:
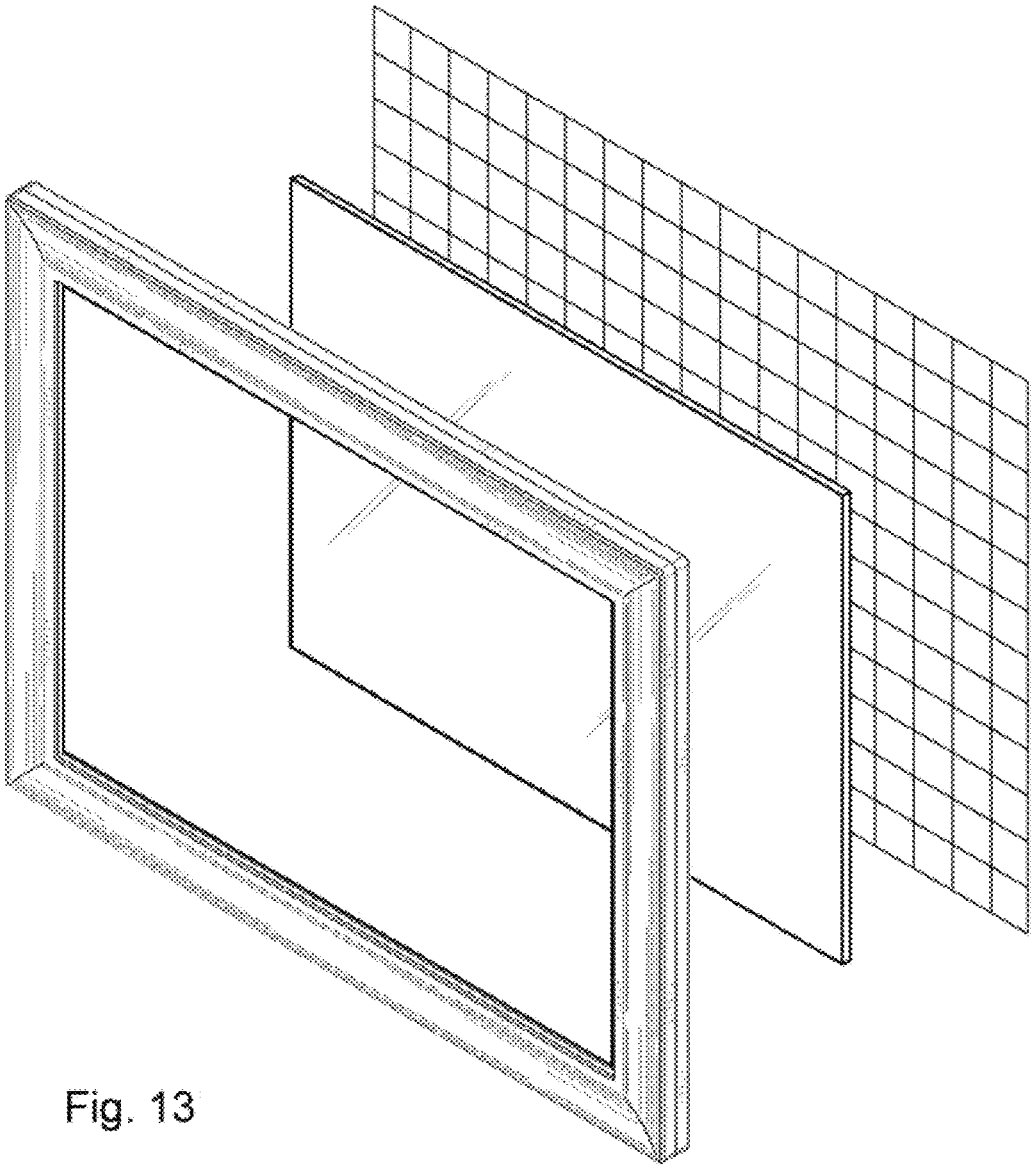
FIG. 13 illustrates an exploded view of the hanging device in accordance with some embodiments of the presently disclosed subject matter.

To use device 5, a user can first position a nail or other hanging implement into the support surface (e.g., wall) at the desired location to hang the device, as depicted in the schematic of FIG. 11. The user can then hang device 5 by positioning the nail or other implement within aperture 40 on the rear face of the device. Because there are a plurality of apertures, finding a suitable aperture is easy and allows the user to insert a single nail and hang the device in a suitable location/orientation each time, if desired (although multiple hanging implements can be used). The device can then be left in place temporarily without additional support, so that a user can observe the location of the of the device.

If a user desires to move the device to the right/left/up/down, they simply remove the device from the wall by withdrawing the hanging implement(s) from a corresponding aperture 40. The location of device 5 can then be adjusted, such that a new aperture at a different location will accommodate the hanging implement. Similarly, the device can easily accommodate a change in orientation (e.g., a rotation of the device) using the same process. Particularly, the device can be removed from the support surface, rotated, and then repositioned on the wall using the same nail by inserting into a new aperture.

It should be appreciated that any suitable device can be hung in accordance with the presently disclosed subject matter, such as a mirror, painting, drawing, display board, poster, artwork, shadowbox, document, diploma, clock, light, cabinet, shelf, and the like. One embodiment of device 5 configured as clock 70 and cabinet 75 are illustrated in FIGS. 12*a*-12*d*. It should be appreciated that any device that can be hung can include a rear face comprising apertures as disclosed above.

The disclosed device offers many advantages over prior art pictures, prints, mirrors, and the like. For example, the device allows a user to hang an object easily and efficiently with a single point (such as a single nail or screw). Alternatively, multiple hanging points can be used (e.g., two or more nails or screws) if desired.

Device 5 is simple to use, such that even children or the elderly can easily hang or adjust the device as needed.

Advantageously, the disclosed device can hang on a single nail, hook, and/or screw, but also has the added functionality of hanging on multiple nails, hooks, and/or screws to hang/orient the device without needing to find the weight balancing point.

The disclosed device enables a single person to hang a picture or mirror without assistance.

In addition, the need for a user to install a wall anchor (screw/nail/hook) in the exact position on the wall is less critical because device 5 can be easily adjusted.

Device 5 is easier to use compared to conventional pictures and mirrors. For example, the plurality of apertures on rear face 11 ensure that the wall anchor is more easily snagged by the apertures in the grid. In comparison, when conventional frames or mirrors are hung, there is often a trial and error period where multiple wall anchors are inserted and then removed to find the perfect hanging position.

Exemplary embodiments of the methods and components of the presently disclosed subject matter have been described herein. As noted elsewhere, these embodiments have been described for illustrative purposes only, and are not limiting. Other embodiments are possible and are covered by the presently disclosed subject matter. Such embodiments will be apparent to persons skilled in the relevant art(s) based on the teachings contained herein. Thus, the breadth and scope of the present invention should not be limited by any of the above-described exemplary embodiments but should be defined only in accordance with the following claims and their equivalents.

What is claimed is:

1. A hanging device comprising:

a front face and an opposed rear face, wherein the rear face is configured as a grid that spans the entire rear face of the device;

a frame at least partially surrounding and attached to the front and rear faces;

wherein the grid defines a plurality of at least 10 apertures of substantially the same size that, with exception to the outer edge are uniformly distributed about the entire rear face of the device towards the front face;

wherein the plurality of apertures extend toward the front face but do not extend through the front face;

and wherein the front face is configured to be removed and replaced as desired by a user.

2. The hanging device of claim 1, wherein the apertures are formed from a plurality of intersecting wires that are attached or connected to the rear face.

3. The hanging device of claim 1, wherein the apertures are configured as individual openings on the rear face.

4. The hanging device of claim 1, wherein at least one aperture differs from at least one other aperture with respect to size, shape, or depth.

5. The hanging device of claim 1, wherein each aperture has a depth of about 0.01-1 inches.

6. The hanging device of claim 5, wherein the depth of each aperture is about 1-20 percent of a thickness of the hanging device.

7. The hanging device of claim 5, wherein the depth of each aperture is about 20-50 percent of a thickness of the hanging device.

8. The hanging device of claim 1, wherein the plurality of apertures comprise about 100-1000 apertures.

9. The hanging device of claim 1, wherein the apertures are positioned on about 100 percent of the rear face of the device.

10. The hanging device of claim 1, wherein the apertures are positioned on about 20-50 percent of the rear face of the device.

11. A method of retaining a hanging device on a support surface, the method comprising:

determining a proper position for retaining the hanging device of claim 1 on the support surface;

positioning a first end of a hanging implement in the support surface at the proper position for retaining the hanging device;

inserting a second end of the hanging implement into an aperture of the hanging device, where the aperture is adjacent to the second end of the hanging device;

whereby the hanging device is retained on the support surface.

12. The method of claim 11, wherein the hanging implement is a nail, hook, or bracket.

13. The method of claim 11, wherein the proper position for retaining the hanging device is adjustable without moving the location of the hanging implement in the support surface.

14. The method of claim 11, wherein the apertures are formed from a plurality of intersecting wires that are attached or connected to the rear face.

15. The method of claim 11, wherein the apertures are configured as individual openings on the rear face.

16. The method of claim 11, wherein at least one aperture differs from at least one other aperture with respect to size, shape, or depth.

17. The method of claim 11, wherein each aperture has a depth of about 0.01-1 inches.

18. The method of claim 11, wherein the hanging device comprises about 100-1000 apertures.

19. The method of claim 11, wherein the apertures are positioned on about 100 percent of the rear face of the device.

20. The method of claim 11, wherein the apertures are positioned on about 20-50 percent of the rear face of the device.

* * * * *